United States Patent [19]

Comerford et al.

[11] 4,280,027

[45] Jul. 21, 1981

[54] SWITCH BLADE MECHANISM AND MULTI-ARRANGEMENT

[75] Inventors: John Comerford, Glendale Heights; Robert E. Zimmer, Niles, both of Ill.

[73] Assignee: The Singer Company, Stamford, Conn.

[21] Appl. No.: 153,445

[22] Filed: May 27, 1980

[51] Int. Cl.[3] ..... H01H 19/00

[52] U.S. Cl. ..... 200/6 A; 200/4; 200/241

[58] Field of Search ..... 200/5 R, 6 R, 6 A, 6 B, 200/6 BA, 6 BB, 6 C, 153 G, 241, 4

[56] References Cited

U.S. PATENT DOCUMENTS

| | | | |
|---|---|---|---|
| 3,879,592 | 4/1975 | Comerford et al. | 200/241 |
| 3,942,148 | 3/1976 | Nishioka | 200/6 A |

*Primary Examiner*—J. V. Truhe
*Assistant Examiner*—Morris Ginsburg
*Attorney, Agent, or Firm*—Bayard H. Michael

[57] ABSTRACT

Four switches are arranged at 90° to each other. Each switch has a reversely bent blade having a short leg pivoted on a center terminal and a long leg having its free end normally spaced from a normally open terminal while the reversely bent portion engages a normally closed terminal higher than the other two terminals whereby the normally open terminal of an adjacent switch can be positioned under the normally closed terminal. The actuator handle actuates opposed parallel pairs in unison whereby one of the pair is actuated to close on its normally open terminal when the actuator moves in one direction and the other of the pair is so actuated when the actuator is moved in the opposite direction.

10 Claims, 7 Drawing Figures

SWITCH BLADE MECHANISM AND MULTI-ARRANGEMENT

TECHNICAL FIELD OF THE INVENTION

The invention relates to a four-way switch of compact design utilizing an improved switchblade configuration permitting placement of the one end of a switch under the other end of an adjacent switch to save space.

BACKGROUND PRIOR ART

The present switch is designed to switch high amperage direct current. Prior art solutions utilized precious metal contacts on leaf spring blades or small stiff rocking blades. The prior art switches have been satisfactory but with the increasing cost of precious metal contacts the cost of such switches becomes less attractive. Furthermore, with the high current capacity required in certain automotive uses the prior art switches were subject to failure without provision of additional wiping action on the contacts which calls for a redesign of the switch.

Comerford U.S. Pat. No. 3,879,592 discloses a switch which has high current capacity without the use of precious metal contacts but that switch blade requires too much space if used in a four-way switch configuration.

DISCLOSURE OF INVENTION

In this invention a flexible metal blade shaped somewhat like the Comerford patent disclosure is formed so that the terminal or fixed support for the normally closed portion of the blade is elevated with respect to the level of the other terminals. This permits using the space below the elevated terminal for the normally open terminal of another blade, thus reducing the space requirement for the two blades. The present blade configuration has superior performance characteristics relative to the prior Comerford design. By arranging four blades into a square configuration while maintaining the overlapping feature mentioned above a compact four-way switch is obtained. With this arrangement four normally closed contacts are positioned above four normally open contacts with each blade perpendicular to the adjacent blades. This reduces the space requirements by at least one-third and the parallel blades are operated by a common actuator. Since the parallel blades are mechnically opposed this will result in one blade closing and wiping while the parallel mate will be given a wiping action only at its normally closed end.

BEST MODE FOR CARRYING OUT THE INVENTION

Figure 1:
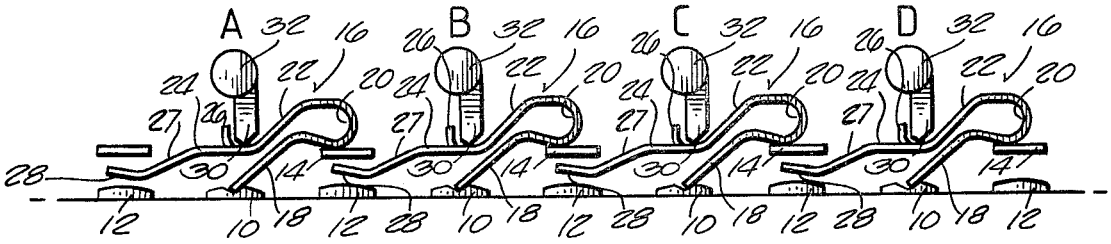
FIG. 1 illustrates the basic concept of this invention with the blades arranged in a linear fashion which can in some instances have utility.
Figure 4:
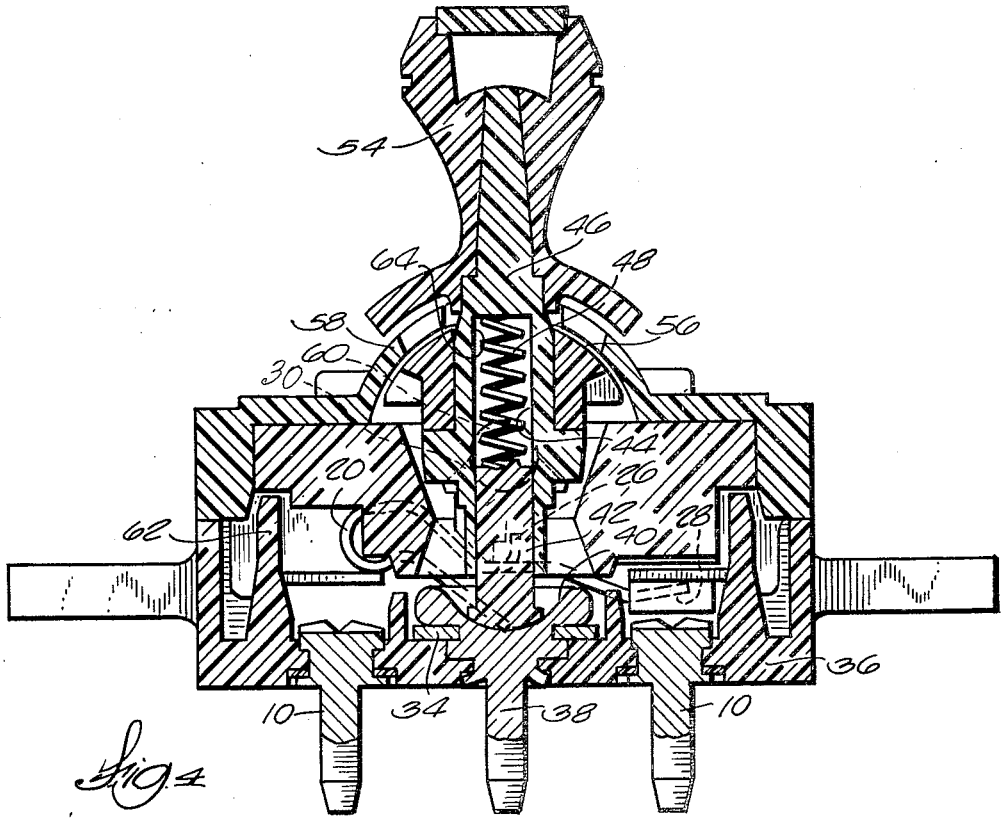
FIG. 4 is a vertical section through the four-way switch showing the manner in which the actuating handle is connected to the actuators.
Figure 2:
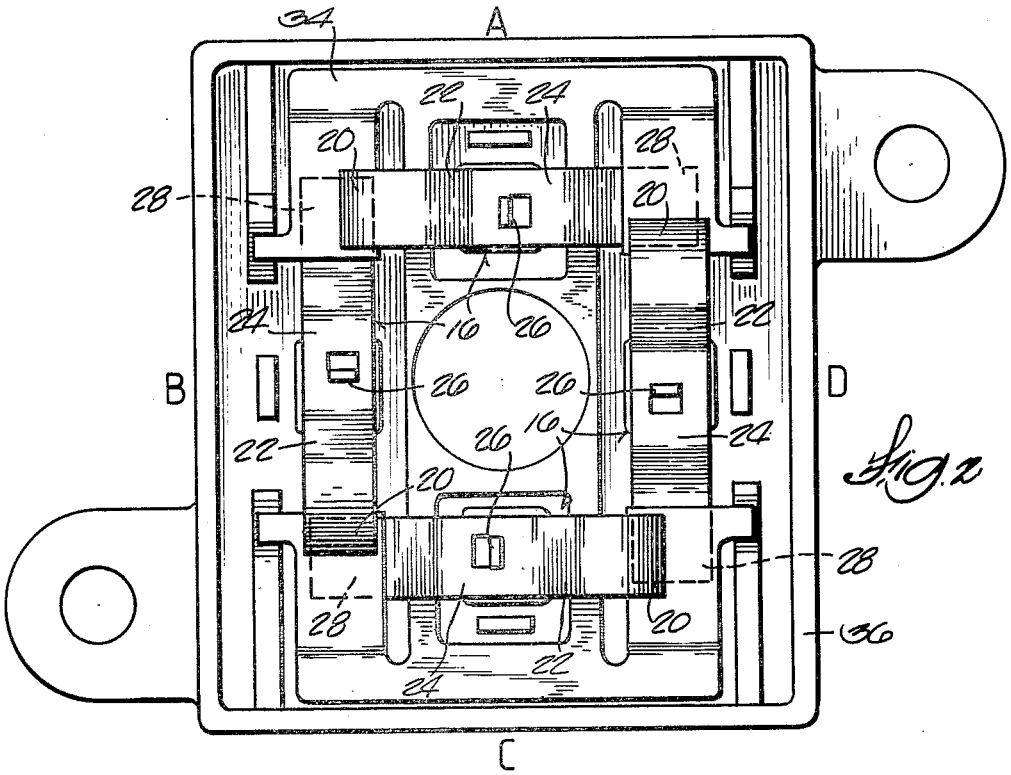
FIG. 2 is a plan view of a four-way switch with the cover of the case removed and without the actuator.
Figure 3:
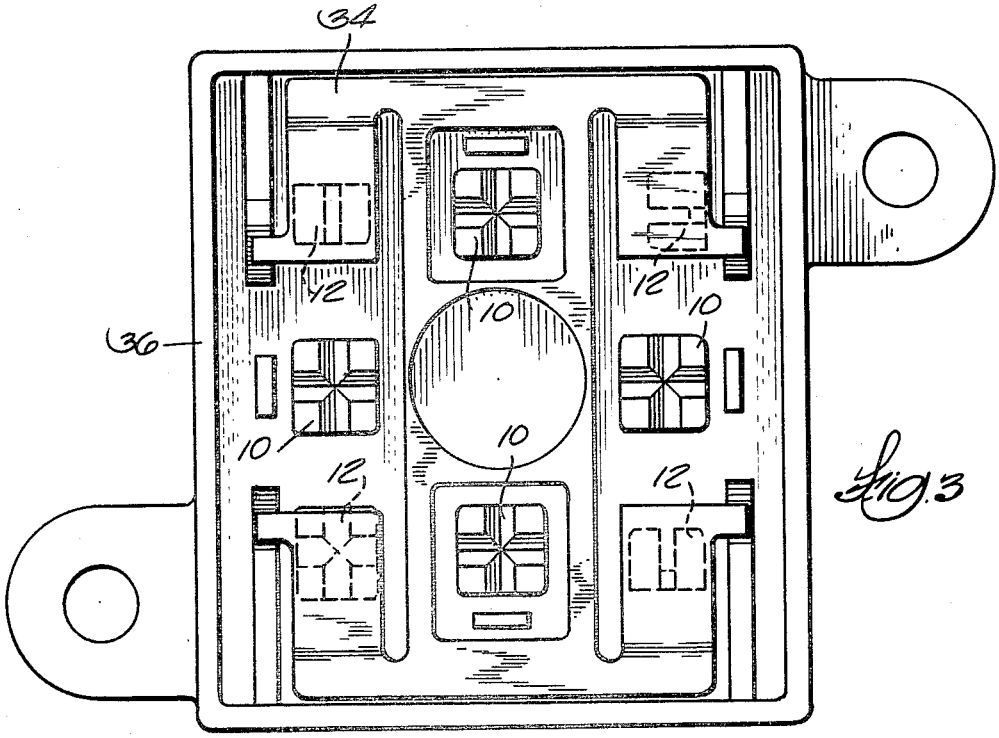
FIG. 3 is similar to FIG. 2 but shows the switchblades removed to better illustrate the busing between terminals.

The present concept is best understood by first considering a linear arrangement of the four switches A, B, C, D as illustrated in FIG. 1. Each switch has a central terminal 10, a normally open terminal 12 and a normally closed terminal 14 elevated with respect to terminals 10 and 12. Resilient switchblade 16 is contoured and reversely bent to provide long and short legs. The short leg is pivoted and has an upwardly inclined portion 18 on the central terminal 10. The upwardly inclined portion leads into reversely bent portion 20 which is bent on a rather large radius, leading into the long leg having a downwardly inclined portion 22 generally parallel to portion 18. The lower end of the portion 22 leads into a horizontal portion 24 having a push tab 26 bent upwardly from a medial portion of the blade. The outer end of the blade is downwardly formed at 27 and terminates in a contact portion 28 normally spaced from terminal 12. An actuator 30 depends from the pivot 32 and engages the long leg of the blade between push tab 26 and upwardly inclined portion 22. When the actuator is rotated about the pivot in the clockwise direction it will engage push tab 26 and its point of engagement with the blade will pass over the centerline between the pivot 32 and the bottom of the notch in terminal 10. This will tilt the blade so that the free end 28 engages terminal 12 and continued motion will distort the blade and push the end 28 across the terminal to get a pronounced wiping action which will serve to break any welding which may have occurred at the terminal. If the actuator is pivoted in a counterclockwise direction, it will engage the upwardly inclined portion 22 and bodily push the blade 16 to the right pulling the pivot end of portion 18 out of the bottom of the notch and sliding the reversely bent portion across the normally closed contact 14. This wiping action will also serve to break any welds. This is a positive translational movement of the blade.

Essentially the switching action is common to the prior Comerford design but this blade configuration is different from that design in that the normally closed contact is elevated with respect to the other two contacts and this results in several advantages. The prior design had a rather sharp reverse bend which tends to build high stresses in the bend. With the present design a substantially larger bend radius is used in portion 20 with consequent reduction in stress at that portion. A further advantage of this arrangement is that the elevated terminal arrangement places the elevated terminal in an area where it is less susceptible to contamination from an adjacent normally open contact. The prior design provided a wiping tab sheared out of the blade to be acted upon by the actuator when it was rotated in the counterclockwise direction. This reduced the beam strength of the blade. In the present design the upwardly inclined portion 22 serves the function of the wiping tab and retains higher strength in the blade.

As far as the four-way switch is concerned the principal advantage of elevating the normally closed contact 14 is that the space underneath that contact is now available for placement of an adjacent normally open contact 12. Thus the normally open contact 12 for switch B in FIG. 1. lies directly under the normally closed contact 14 for switch A. Similar considerations apply to the switches C and D. It is apparent in FIG. 1 that the overall length of the four switches is reduced substantially because one switch overlies the other. From this linear arrangement it is apparent that each switch can be turned 90° relative to the adjacent switches and this, with four switches, will result in a square configuration such as illustrated in the other figures of this application. Thus in the square configuration the switches A, B, C, and D are arranged at 90° to one another with the normally closed terminal 14 overlying the normally open terminal 12 of the adjacent switch in the counterclockwise sense.

The present four-way switch is designed for use in a circuit in which all of the normally closed (elevated) terminals 14 are electrically interconnected and in this design this is done simply by stamping and forming all of those terminals from a common metal plate 34 fixed in the switch case 36 by fitting between molded parts preventing the rotation of the plate. The plate is electrically connected to the outside of the case by a center connector 38 having a dished socket 40 receiving the spring loaded pin 42 slidably received in a blind hole 44 in post 46. The pin is biased downwardly by compressed spring 48. The post projects through the two actuator assemblies 50, 52 and is received in the actuator handle 54. Actuator assembly 52 is provided with an upwardly facing partially spherical surface 56 which bears against the inside of the switch housing cover 58 and has diametrically opposed projecting shafts 60 which carry the depending actuators 30 which bear against the switch blades. The resiliency of the switch blades acts against the actuators to hold the stub shafts 60 up into semi-cylindrical grooves molded in the underside of the cover 58. The bottom of the switch case has molded upwardly projecting fingers (not shown) which bear against the shafts 60 to prevent the shafts from moving downwardly. The post 46 has a generally square cross section which projects through the rectangular aperture 64 in actuator assembly 52. The post 46 tends to rise upwardly by reason of the compression of spring 48 but is prevented from rising past its assembled position by engagement of trunnions 66, 66 with the sockets 67 formed in the actuator assembly.

Figure 5:
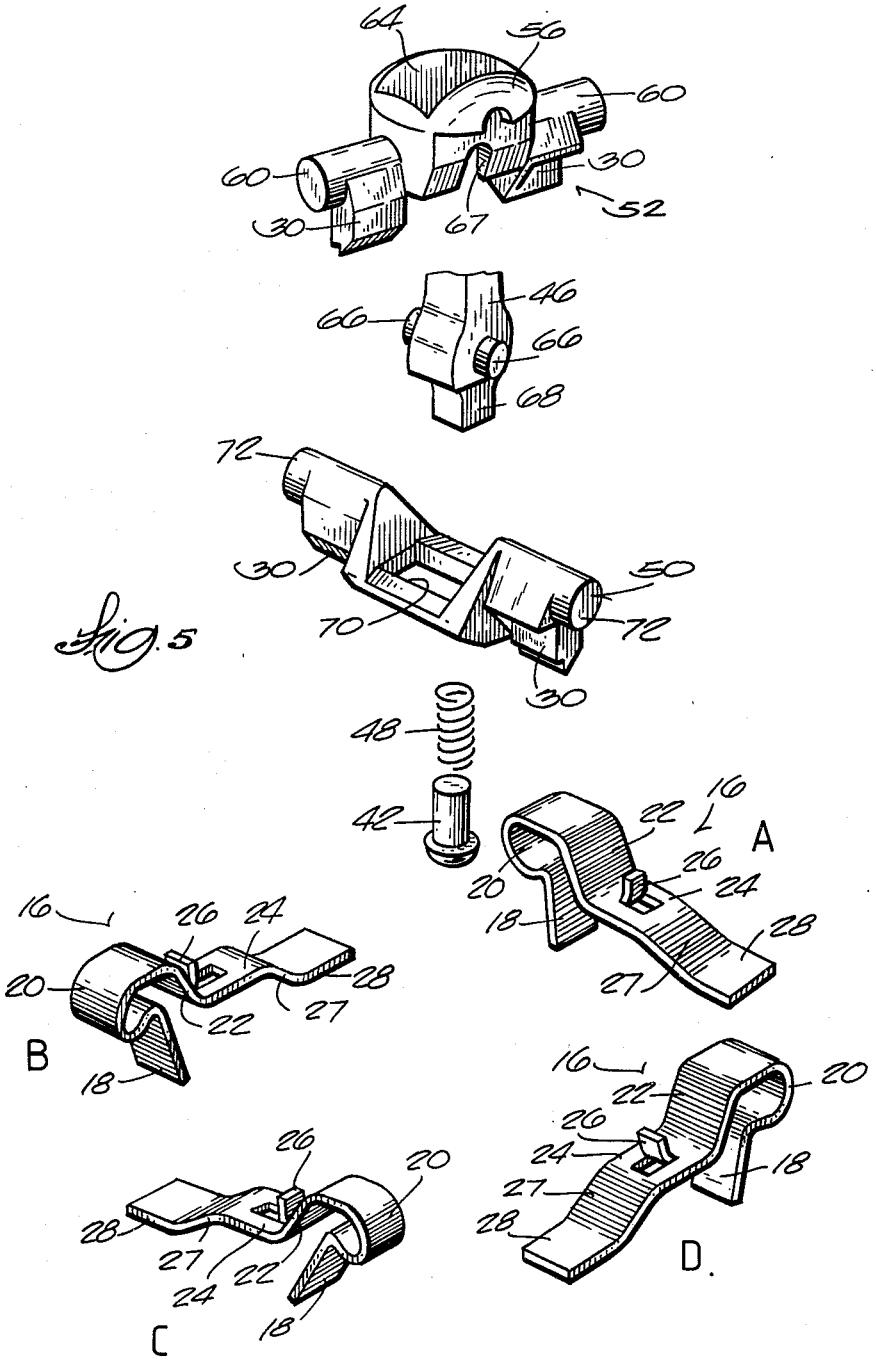
FIG. 5 is an exploded fragmentary view of the principal parts of the four-way switch.

When the post (actuator handle) is moved to move the post 46 transverse the long axis of aperture 64 the actuator assembly 52 must pivot about the axis of shafts 60, 60. This will actuate actuators 30, 30 carried by the assembly 52. The lower square portion 68 of the post 46 passes through the rectangular aperture 70 in the actuator assembly 50. It will be noted that aperture 70 is at right angles to the aperture 64 in actuator assembly 52. Therefore, when the actuator handle is moved as described above the square section 68 of post 46 merely moves back and forth along the long axis of aperture 70. When, however, the actuator handle is moved at 90° to that direction, the upper portion of the post now moves freely in aperture 64 while the lower portion moves transverse the long axis of aperture 70 and rocks assembly 50 about the axis of stub shafts 72, 72. This will, therefore, cause the actuators 30, 30 carried by assembly 50 to actuate the parallel pair of blades opposite the pair actuated on the first mentioned actuation. Thus, viewing FIG. 5, the first mentioned actuation would actuate the switch pair A, C and actuation at 90° to that would actuate pair B, D. The stub shafts 72 are also prevented from downward movement by upwardly projecting fingers 62 molded in the bottom of the switch case.

Since the radius of curvature of the dished socket 40 in the center connector 38 is smaller than the distance from the bottom of the dish to the center of the shaft 60 the compression of spring 48 will always tend to drive the pin to the outermost position. This tends to return the actuating handle to the center position. Since the actuators act against blades which press upwardly against the actuators, they also exert a centering force on the actuator handle.

Reverting now to the electrical connections within the switch case, the center terminals 10 are in all cases electrically independent while all of the normally open terminals 12 are electrically connected which can be conveniently done by stamping all of the terminals out of a single piece of metal (a buss) which is then formed up through the case and turned over to make the terminal configuration while one is provided with a through connection connecting to the buss or if desired all can be independent connectors as illustrated.

From the description it is clear that in the normal position of the switch blade the blade connects the center terminal 10 to the elevated terminal 14 and all elevated terminals are interconnected. Therefore, while the clearance between the free end of the blade and the underside of the elevated terminal of an adjacent switch appears to be quite close in the normal position (FIG. 6), it makes no difference if the tip of the blade were to touch that terminal.

Figure 6:
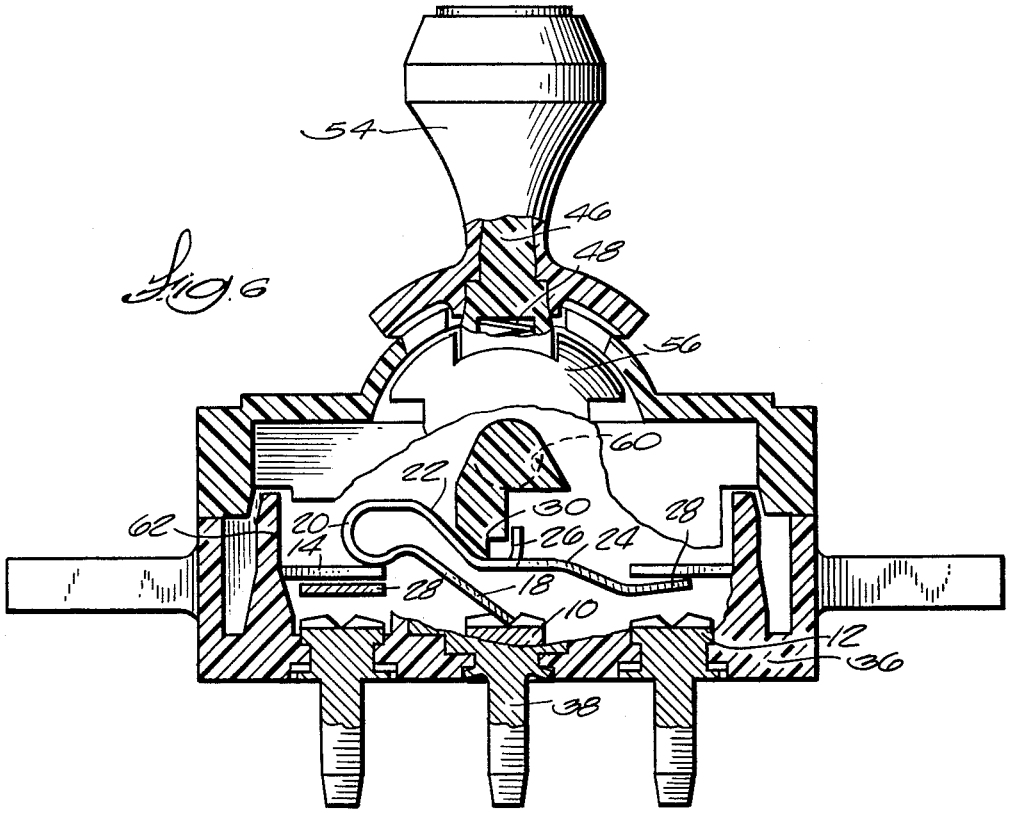
FIG. 6 is a vertical section through the switch with parts broken away to illustrate the normal position and the actuator.
Figure 7:
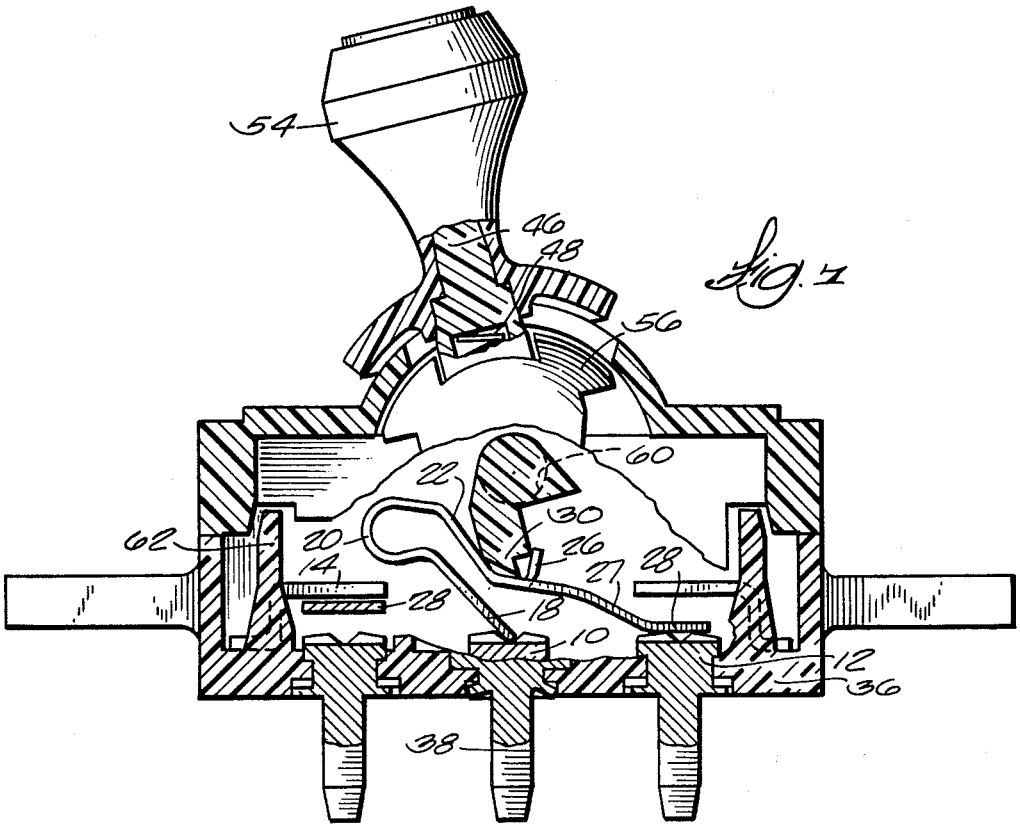
FIG. 7 is a vertical section illustrating the actuated position of the switch with the free end of the blade in engagement with the normally open contact.

When the actuator is rocked to the left in FIG. 6, to move actuator 30 counterclockwise about its pivot the actuator engages the push tab 26 and the point of engagement between the actuator and the blade passes over the centerline between the pivot point of shafts 60 and the bottom of the notch in contact 10 which is the pivot point of the blade. When this happens, the free end of the blade 28 moves downwardly with a snap action to engage the normally open terminal 12 and continued movement of the actuator in a counterclockwise direction against tab 26 will cause the blade to distort and wipe end 28 across the terminal. The actuated position is shown in FIG. 7 and it will be noted the blade has lifted off terminal 14. Thus, the center terminal 10 is now in circuit with the normally open terminal 12 and the normally closed circuit from 10 to 14 is open.

When the actuator 30 is moved clockwise from the normal position shown in FIG. 6, the backside of the actuator which has a slope generally corresponding to the upwardly sloping portion 22 of the blade will engage that portion of the blade and push the blade bodily to the left pulling the pivot end 18 of the blade out of the bottom of the notch in the center terminal 10 and wiping the normally closed portion of the blade across the elevated terminal 14.

The present four-way switch has higher current capacity than other commercially available four-way switches of comparable size and has excellent wiping characteristics and does not require the use of any precious metals. Therefore, the cost is lower. Due to the overlapping arrangement of the switches it results in a very compact package. By being able to overlap the switches with the simple expedient of elevating the normally closed terminal and permitting the adjacent normally open terminal to occupy the same air space the switches are made substantially more compact.

It will be appreciated that if it is desired to simply make a circuit from the center terminal to the normally open terminal the elevated position need not be a terminal as such but may be fixed support.

The basic switch can have utility as a single switch or as an opposed pair. In either case, the important aspect of each switch is to provide two generally co-planar terminals and a reversely bent blade having a short leg pivoted on one of the terminals, a reverse bend elevated above the plane of the two terminals and a long leg of the blade extending over the one terminal to overlie the other terminal. The actuator acts on the long leg of the blade between the reverse bend and the line connecting the actuator pivot and the blade pivot and passes over the centerline to effect switching action.

We claim:

1. A switch assembly enclosed in a housing and including a switch comprising first and second terminals mounted in the housing in generally the same plane, a resilient switch blade reversely bent to provide long and short legs, the short leg being pivotally mounted on the first terminal and the free end of the long leg overlying and spaced from the second terminal, a fixed support in the housing elevated with respect to said plane, an actuator pivoted in the housing and normally engaging the long leg of the blade between the reverse bend and the centerline joining the blade pivot point and the actuator pivot point so as to normally hold the reversely bent portion of the blade against the support, actuation of the actuator in one direction moving its point of engagement with the blade along the long leg past said centerline to cause the blade to pivot and bring the free end of the long leg into contact with said second terminal.

2. A switch assembly according to claim 1 in which said support is a third terminal and the reversely bent portion of the blade moves out of contact with the third terminal as said free end moves into contact with the second terminal.

3. A switch assembly according to claim 2 in which the long leg is provided with means engaged by said actuator to push the free end across the second terminal with a wiping action after the free end has moved into engagement with the second terminal.

4. A switch assembly according to claim 3 in which the long leg is provided with means engaged by said actuator when the actuator is moved in the direction of opposite said one direction so the reversely bent portion of the blade is wiped across said third terminal.

5. A switch assembly according to claim 2 including a second switch the same as the first switch and arranged in the housing with the second terminal of one switch underlying the third terminal of the other switch.

6. A switch assembly according to claim 2 including three additional switches the same as the first switch, all of the switches being mounted in the housing with each blade arranged at right angles with respect to the adjacent blades, the second terminal of each switch being under the third terminal of an adjacent switch,

7. A switch assembly according to claim 6 in which the actuators for opposed parallel pairs of switches are operated in unison with the switching action of the parallel switches being opposite.

8. A switch assembly according to claim 7 in which a single actuator handle operates the actuators for all four switches, means constraining movement of the handle to movement in two planes intersecting at right angles whereby movement of the handle in one of its planes actuates the switches in one parallel pair and movement in the other of its planes actuates the switches in the other parallel pair.

9. A switch assembly according to claim 1 in which the portion of the long leg adjacent the reversely bent portion of the blade is generally parallel to the short leg and the radius of curvature of the reversely bent portion is relatively large.

10. A switch assembly according to claim 9 in which the actuator bears against the portion of the long leg which is generally parallel to the short leg when the actuator is moved in the opposite direction to cause the reversely bent portion of the blade to wipe across the support.

* * * * *